US006156985A

United States Patent [19]

Chiang

[11] Patent Number: 6,156,985

[45] Date of Patent: Dec. 5, 2000

[54] PUSH BUTTON SWITCH

[75] Inventor: Chih Hsiang Chiang, Taoyuan Hsien, Taiwan

[73] Assignee: Acer Peripherals, Inc., Taoyuan, Taiwan

[21] Appl. No.: 09/411,518

[22] Filed: Oct. 4, 1999

[30] Foreign Application Priority Data

Oct. 9, 1998 [TW] Taiwan ..... 87216753

[51] Int. Cl.[7] ..... H01H 13/70

[52] U.S. Cl. ..... 200/344

[58] Field of Search ..... 200/5 A, 512, 200/517, 344, 345; 400/490, 491, 491.2, 495, 495.1, 496

[56] References Cited

U.S. PATENT DOCUMENTS

| | | | |
|---|---|---|---|
| 5,463,195 | 10/1995 | Watanabe et al. | 200/5 A |
| 5,466,901 | 11/1995 | Mochizuki | 200/5 A |
| 5,746,308 | 5/1998 | Lin | 200/344 |
| 5,758,763 | 6/1998 | Sanda et al. | 200/344 |
| 5,799,772 | 9/1998 | Sanda et al. | 200/344 |
| 5,842,798 | 12/1998 | Su | 400/491.2 |
| 5,986,227 | 11/1999 | Hon | 200/344 |

*Primary Examiner*—Michael Friedhofer
*Attorney, Agent, or Firm*—Ladas & Parry

[57] ABSTRACT

A scissors-type push button switch having slanted surfaces on top of first and second bearing slots that are integrated to the surface of a bottom base plate. The slanted surfaces are designed as such so that lateral cylindrical protrusions located on one end of a linking bracket can snap in the bearing slots in position with just a single push towards the base plate which reduces cycle time during the component assembly process. In particular, the first slanted surface and the spaced-apart second slanted surface, for guiding insertion, are slantingly recessed surfaces that tilt slightly towards each other and directly above the first and second bearing slots. In a second embodiment, the surfaces on top of the first and bearing slots are flat and the ends of the lateral cylindrical protrusions are chamfered to form slanted surfaces slanted away from each other.

16 Claims, 10 Drawing Sheets

PUSH BUTTON SWITCH

BACKGROUND OF THE INVENTION

1. Field of the Invention

The present invention relates to a push button switch mechanism; more specifically, the invention relates to a scissors-type push button switch having slanted surfaces above the bearing slots integrated into the surface of the base plate. The slanted surfaces are designed so that lateral cylindrical protrusions located at free ends of a linking bracket can be snapped into the bearing slots with a single push towards the base plate.

2. Description of Related Art

FIG. 1 shows an exploded view of a push button switch having scissors-type arm members disclosed in Taiwanese Patent NO. 86,200,053 and U.S. Pat. No. 5,746,308.

As illustrated in FIG. 1, a push button switch of prior art comprises a first linking bracket 17 having two arm elements 171, wherein a lateral cylindrical protrusion 174*a* is located at the end of each arm element. Each of the two lateral cylindrical protrusions 174*a* faces outwardly and is fixed in place by insertion into the bearing slots 183 formed by bending out parts of base plate 18 into an upright position above the surface 185.

When lateral cylindrical protrusions 174*a* of the two arm elements 171 are to be inserted into the bearing slots 183, an external force has to be exerted laterally on the outward surface of each of the arm elements 171 to decrease the distance between the two cylindrical protrusions 174*a*. The two cylindrical protrusions 174*a* are inserted into the bearing slots 183 while being squeezed and then released to click into position. This squeezing and releasing adds complexity to the assembly process, increasing the overall manufacturing cycle time for each push button assembly.

SUMMARY OF THE INVENTION

Accordingly, it is an object of the present invention to provide a push button switch that solves the above problem by providing a push button assembly in which the bracket can be assembled to the base by a simple push-down action.

The present invention achieves these objects by providing a push button switch comprising: a base plate having at least a first slide guiding slot and two first bearing slots formed on its surface, wherein each first bearing slot comprises a groove formed in the base plate and a slanted strip over a portion of the groove, the slanted surface of the two slanted strips being slanted towards each other; a key cap having an underside and movable along a specified path between a higher position and a lower position, wherein there are a pair of second slide guiding slots and a pair of second bearing slots formed on the underside of the key cap; a first linking bracket of rectangular shape comprising two parallel first arm elements, a transverse sliding rod disposed between first ends of the first arm elements, and a bearing rod disposed between second ends of the first arm elements, wherein a first coupling element is formed at about the middle point along the length of each of the first arm elements; a second linking bracket of U-shape comprising two parallel second arm elements and a transverse bar bridging the second arm elements at a third end, each second arm element having a lateral latch member at a fourth end, wherein the lateral latch members extend away from each other, and wherein a cylindrical sliding protrusion protrudes straight out of each end of the transverse bar, and a second coupling element is formed at about the middle point along the length of each of the second arm elements for coupling with the first coupling element of the first linking bracket so as to form two cross-linked pivot joints; a plunger made of springy material situated in the space between the key cap and the base plate, the key cap being elevated dynamically from the lower position to the higher position by the spring action of the plunger; wherein, the sliding rod is rotatably and slidably received by the first slide guiding slot, the bearing rod is rotatably received within the second bearing slots, the cylindrical sliding protrusions are rotatably and slidably received by the second slide guiding slot, and the latch members are rotatably received by the first bearing slots by pressing the latch members down on the slanted surfaces of the first bearing slots such that the second arm elements bend towards each other and the latch members are received in the grooves and retained under the slanted surfaces.

The slanted surfaces above the bearing slots integrated into the surface of the base plate of the present invention allow the lateral latch members located on one end of the linking bracket to be snapped into the bearing slots with a single push towards the base plate. This simple snap-in assembly reduces the overall manufacturing cycle time for each push button assembly, thereby reducing costs.

In a second embodiment of the invention, the first bearing slots are provided with flat top surfaces and the lateral latch members are provided with chamfered ends forming slanted surfaces slanted away from each other. In this embodiment, the slanted surfaces also allow the lateral latch members located at the fourth end of the second linking bracket to be snapped into the first bearing slots with a single push towards the base plate. As in the first embodiment, this simple snap-in assembly decreases the overall manufacturing cycle time for each push button assembly, thereby reducing costs.

Furthermore, a third embodiment provides an alternative coupling arrangement between the keycap and the second end of the first linking bracket on top of the push button switch design according to the first embodiment. Such coupling arrangement is characterized by replacing the second bearing slots formed on the underside of the key cap with a pair of third bearing slots each having a slanted strip on top similar to the first bearing slots located on the base plate. Comparably, the keycap with said third bearing slots having slanted top surfaces is capable of quick assembly with the second end of the first linking bracket by a simple push-down action, similar to the assembly steps for coupling the fourth end of the second linking bracket to the base plate.

BRIEF DESCRIPTION OF THE DRAWINGS

Other objects, features, and advantages of the present invention will become apparent from the following detailed description of the preferred but non-limiting embodiment. The description is made with reference to the accompanying drawings in which.

DETAILED DESCRIPTION OF THE PREFERRED EMBODIMENT

Figure 1:
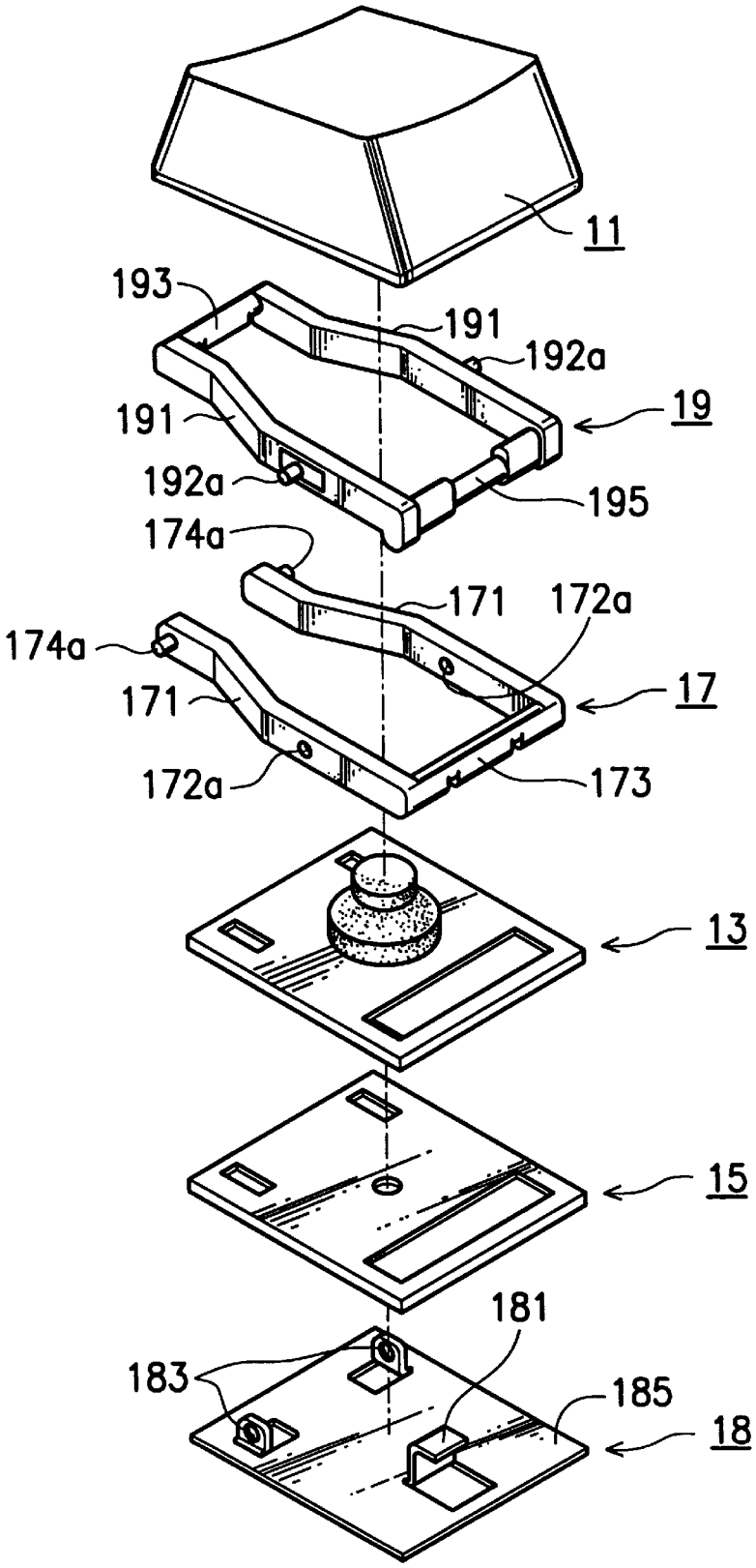
FIG. 1 (PRIOR ART)
FIG. 1 is an exploded view of a push button switch of the prior art.
Figure 2:
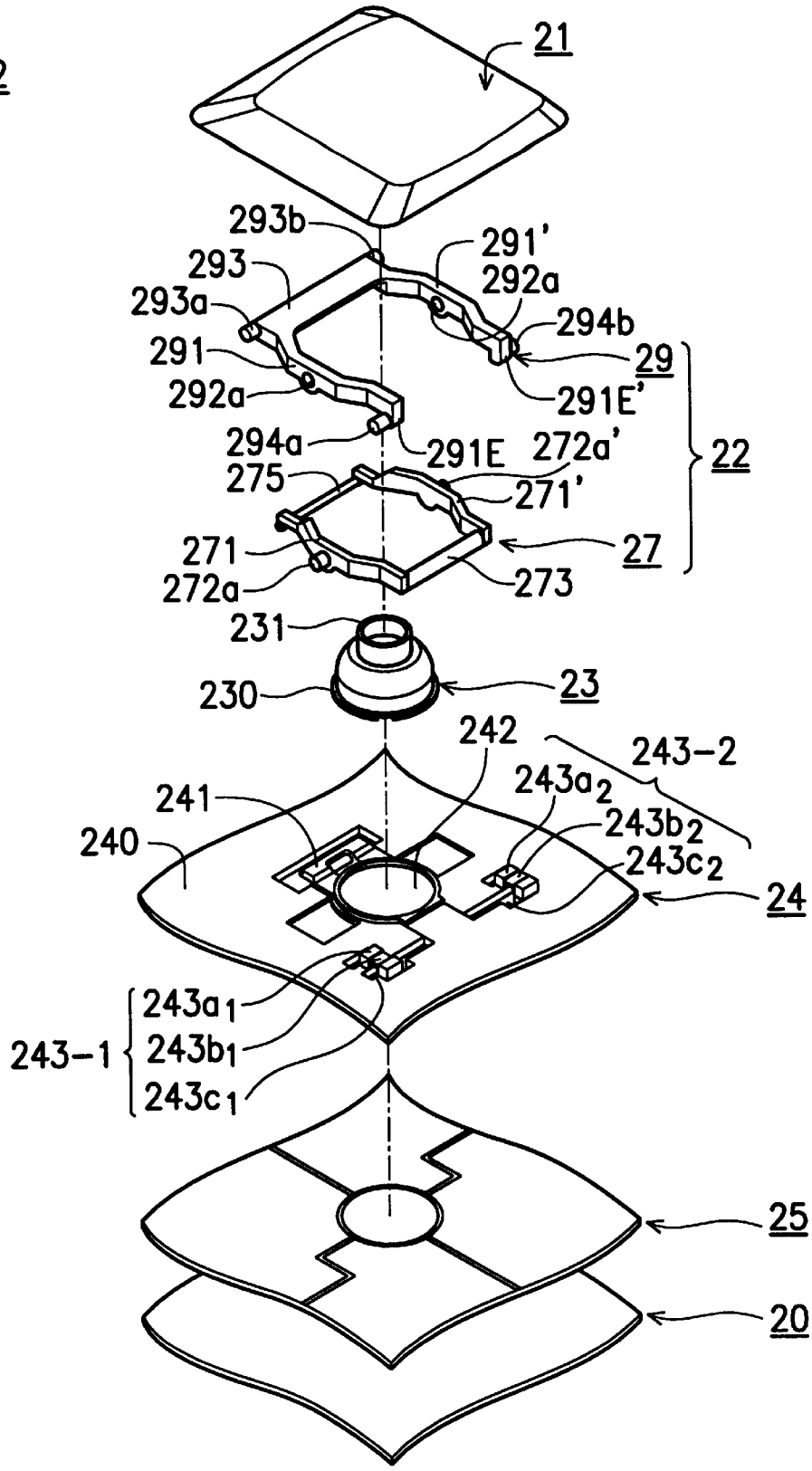
FIG. 2 is a perspective drawing depicting the push button switch according to the first embodiment of the present invention.

First Embodiment:

Referring to FIG. 2, a push button switch 2 comprises a foundation sheet 20, a membrane circuit switch 25, a base plate 24, a dome-shaped plunger 23, a key cap supporting sub-assembly 22, and a key cap 21. The membrane circuit switch 25 is a thin film flexible circuit device turned on and off by the electricity-conducting bottom surface of the dome-shaped plunger 23, and the key cap supporting sub-assembly comprises a first linking bracket 27 having a first end and an opposite second end and a second linking bracket 29 having a third end and an opposite fourth end.

Figure 3:
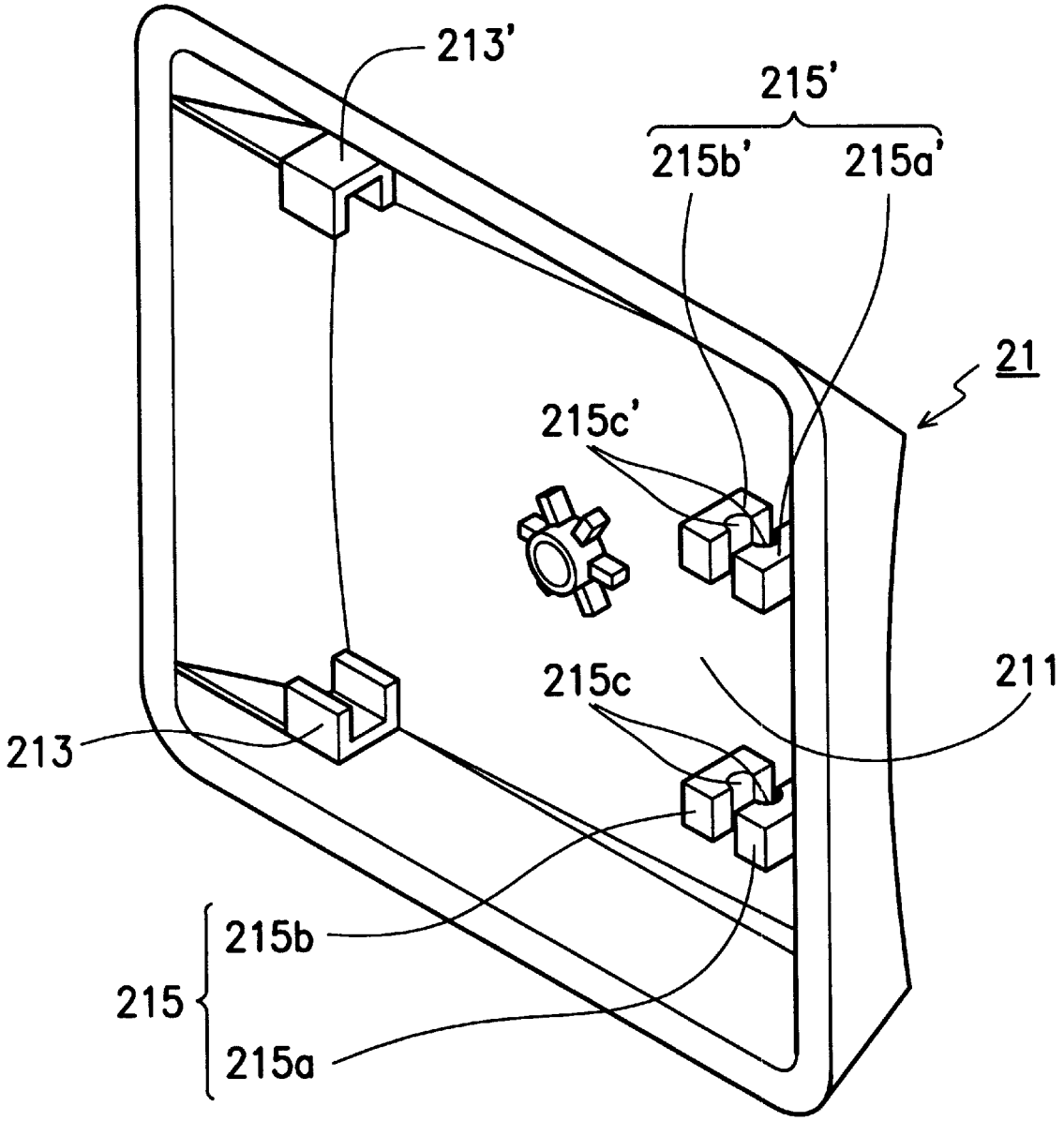
FIG. 3 is an enlarged perspective view of the key cap with its underside revealed according to the first embodiment of the present invention.

Furthermore, as shown by FIG. 3, the underside structure 211 of the key cap 21 comprises integrated second slide guiding slots 213 and 213' and a pair of third bearing slots 215 and 215'. Specifically, the second slide guiding slots 213 and 213' are a pair of miniature C-shape guide rails, and the third bearing slots 215 and 215' are two identical pairs of opposing indented blocks 215*a*, 215*b*, 215*a*', and 215*b*', with opposing grooves 215*c* and 215*c*' formed thereupon by which the bearing rod 273, positioned at the second end of the first linking bracket, is embraced and retained.

Now referring back to FIG. 2, a first slide guiding slot 241 and a pair of opposing first bearing slots 243-1 and 243-2 are located on the upper surface 240 of the base plate 24 that faces towards the key cap 21. In addition, a circular hole 242 is formed through the base plate 24 and situated in between the first slide guiding slot 241 and the first bearing slots 243-1 and 243-2, wherein the dome-shaped plunger 23 is fixed in place by fitting to the circular hole 242.

Figure 4:
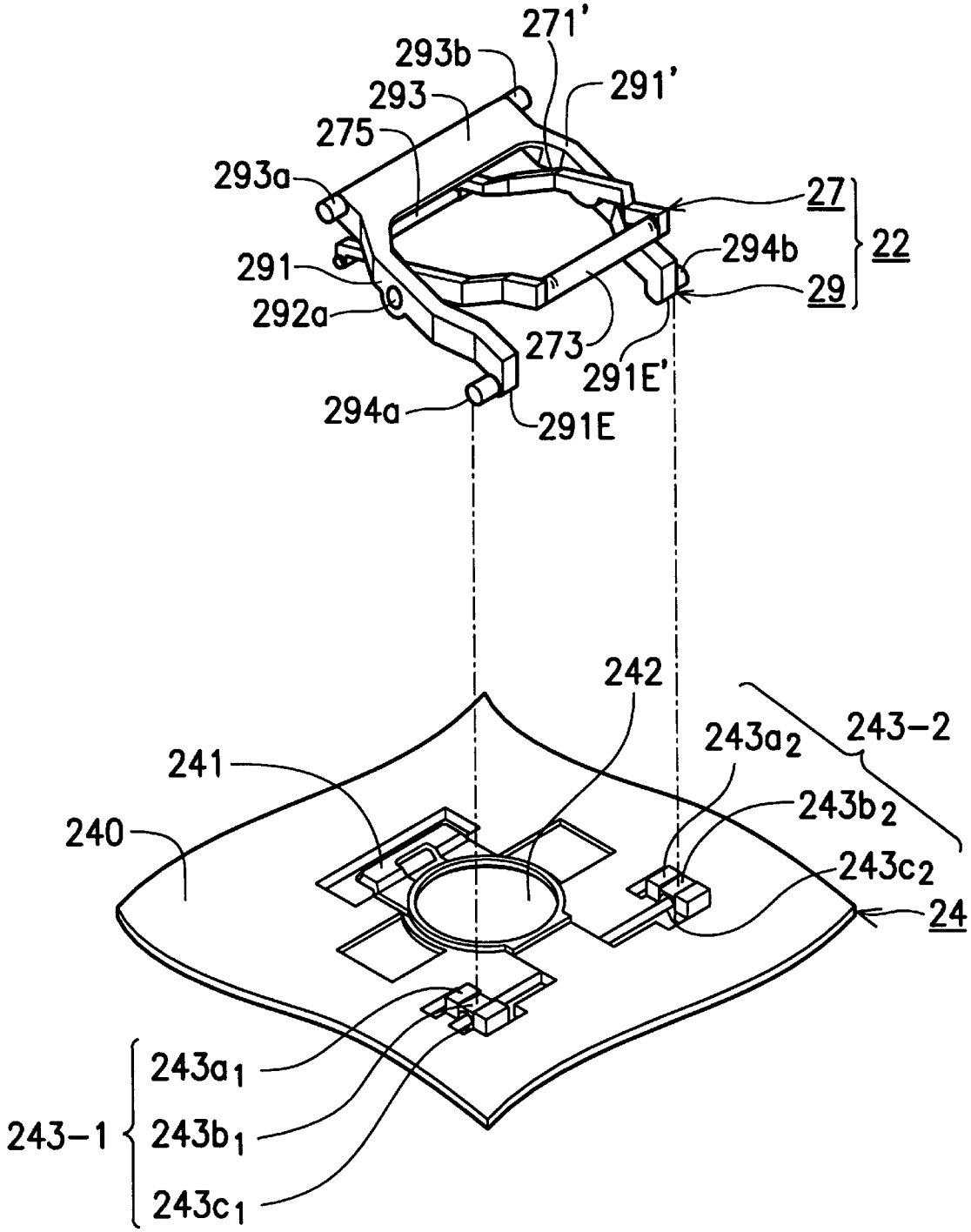
FIG. 4 shows exploded and enlarged perspective views of the linked first and second linking brackets and the base plate according to the first embodiment of the present invention.

FIG. 4 indicates the corresponding spatial relationship between a key cap supporting sub-assembly 22, wherein first and second linking brackets 27 and 29 are linked before being assembled to base plate 24. The first slide guiding slot 241 is a flange-like protrusion for retaining the first sliding rod 275, positioned at the first end of the first linking bracket, in a specified course. The bearing slots 243-1 and 243-2 respectively comprise grooves $\mathbf{243}c_1$, $\mathbf{243}c_2$ in the surface 240 and blocks $\mathbf{243}a_1$, $\mathbf{243}a_2$. Slanted surfaces $\mathbf{243}b_1$ and $\mathbf{243}b_2$ are formed on the surfaces $\mathbf{243}a_1$, $\mathbf{243}a_2$ over grooves $\mathbf{243}c_1$, $\mathbf{243}c_2$, respectively, forming recesses thereunder, wherein the slanted surfaces are recessed and tilt slightly towards each other; the rectangular openings adjacent to grooves $\mathbf{243}c_1$ and $\mathbf{243}c_2$ are formed in consideration of movement clearance for the free ends 291E and 291E'. The recesses can be formed in the shape of a cylindrical hollow.

Accordingly, the key cap supporting sub-assembly 22 is composed of a first linking bracket 27 and a second linking bracket 29 cross-linked to form a scissors-type supporting structure. The key cap 21 is coupled to and supported by the key cap supporting sub-assembly 22 in such fashion that dynamic key cap movements in the space directly above the base plate 24 follow a certain path.

The following is a detailed description of the cross-link relationship between the first linking bracket 27 and the second linking bracket 29 of the key cap supporting sub-assembly 22.

As shown by FIG. 2, a first linking bracket 27 with two first arm elements 271 and 271' has a transversely integrated sliding rod 275 at the first end and a bearing rod 273 at the second end, wherein both rods connect the parallel first arm elements 271 and 271' to form a rectangular first linking bracket 27. In addition, first coupling elements, e.g. outwardly facing integrated lateral first cylindrical protrusions 272*a* and 272*a*', are formed at the middle point along the length of each of the respective first arm elements 271 and 271', respectively, to act as pivot joints for a cross-link with the second linking bracket 29.

The second linking bracket 29 comprises two second arm elements 291 and 291' bridged at the third end by a transverse bar 293 to form a U-shape. Outwardly facing laterally integrated second cylindrical protrusions 294*a* and 294*b* are formed normal to the free ends 291E and 291E', or the fourth end, of the two second arm elements 291 and 291', respectively. Integrated cylindrical sliding protrusions 293*a* and 293*b* are formed protruding straight out of respective ends of the transverse bar 293. In addition, two second coupling elements, e.g. open holes 292*a* and 292*a*' are each formed at the middle point along the length of each of the respective second arm elements 291 and 291' for receiving each of the two first cylindrical protrusions 272*a* and 272*a*' of the first linking bracket 27 and forming two scissors-type pivot joints, as shown in FIG. 4.

The assembled scissors-type linkage, or the key cap supporting sub-assembly 22, has four different types of coupling joints for connection to the rest of the push button switch (the key cap 21 and the base plate 24); such couplings are the sliding rod 275 and the bearing rod 273 of the first linking bracket 27, and the cylindrical sliding protrusions 293*a* (293*b*) and lateral latch members, e.g. the second cylindrical protrusions 294*a* (294*b*) of the second linking bracket 29. Specifically, the bearing rod 273 is rotatably retained by the third bearing slots 215 and 215' of the key cap 21; the sliding rod 275 is rotatably and slidably retained by the flange-like first slide guiding slot 241 of the base plate 24 as shown in FIG. 2; the two cylindrical sliding protrusions 293*a* and 293*b* are rotatably and slidably retained by the C-shape second slide guiding slots 213 and 213' of the key cap 21 as shown in FIG. 3; and finally, the second cylindrical protrusions 294*a* and 294*b* are rotatably coupled to the first bearing slot 243-1 and the second bearing slot 243-2 of the base plate 24.

Referring to FIG. 4, the second linking bracket 29 is assembled to the base plate 24 by first placing the second cylindrical protrusions 294*a* and 294*b* directly over the corresponding first bearing slot 243-1 and 243-2, and then pushing said protrusions straight down towards the base plate 24 until they snap in and are retained in grooves 243$c_1$ and 243$c_2$ under surfaces 243$b_1$ and 243$b_2$. Specifically, when the second cylindrical protrusions 294*a* and 294*b* are pressed against the slanted surfaces of the first bearing slots, an opposing force will be automatically exerted by the slanted surfaces that redirect a portion of the downward force to squeeze the second arm elements 291 and 291' and close in on the distance between the two said protrusions, allowing for a quick and easy insertion into said first bearing slots.

According to another embodiment of the present invention, in place of bearing rod 273 of the rectangular first linking bracket 27, lateral latch members similar to the second cylindrical protrusions 294*a* (294*b*) of the second linking bracket 29 can be provided at the second end of the first linking bracket 27, and in place of second bearing slots 215 and 215' of the key cap 21, grooves with a slanted strip over a portion of each groove for a quick and easy insertion into the underside 211 of the keycap 21.

Figure 5:
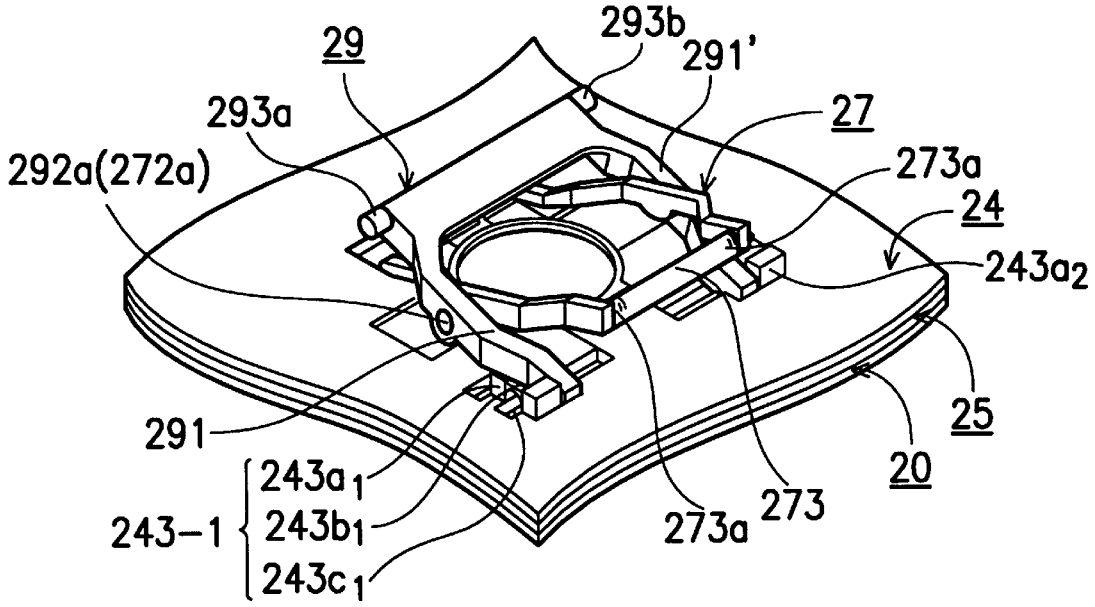
FIG. 5 is an enlarged perspective view depicting the linked first and second linking brackets and the base plate after they are put together according to the first embodiment of the present invention.
Figure 6A:
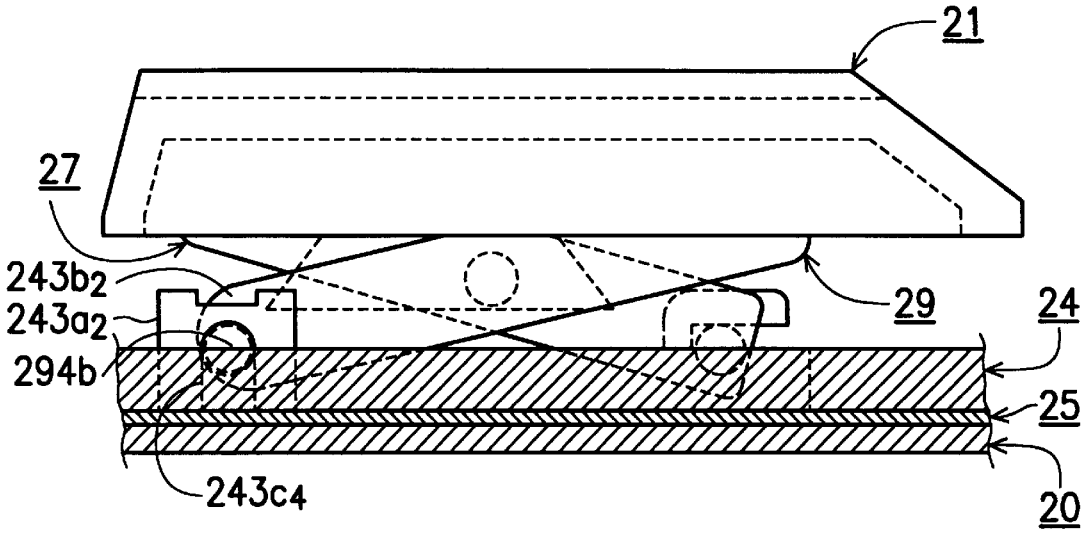
FIG. 6A is a side view of the key cap and the rest of the push button switch assembly thereto in an elevated position according to first embodiment of the present invention.
Figure 6B:
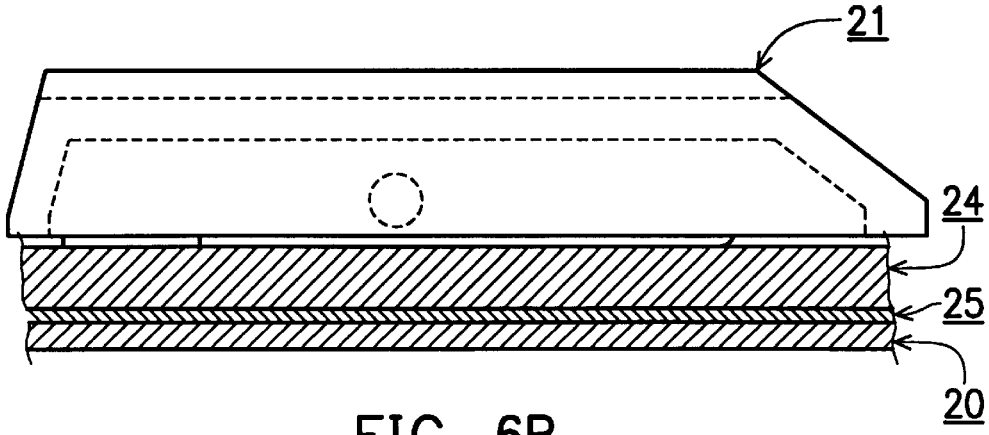
FIG. 6B is a side view of the key cap and the rest of the push button switch assembly thereto in a compressed position according to first embodiment of the present invention.

FIG. 5 is a perspective view depicting the key cap supporting sub-assembly 22 properly installed to the base plate 24 according to the first embodiment of the present invention. FIGS. 6A and 6B are side views of the assembled push button switch at an elevated position and at a compressed position, respectively, according to the first embodiment of the present invention. In the elevated position, the dome-shaped plunger is in its relaxed state; in the compressed position, the dome-shaped plunger is compressed and ready to rebound.

In order to further simplifying the assembly process, the longitudinal edges of the grooves 243$c_1$ and 243$c_2$ can be chamfered to provide strips of slanted surfaces on surface 240 immediately adjacent to and along the edges of the grooves for easier slip-in of the second cylindrical protrusions 294*a* and 294*b*.

Figure 7:
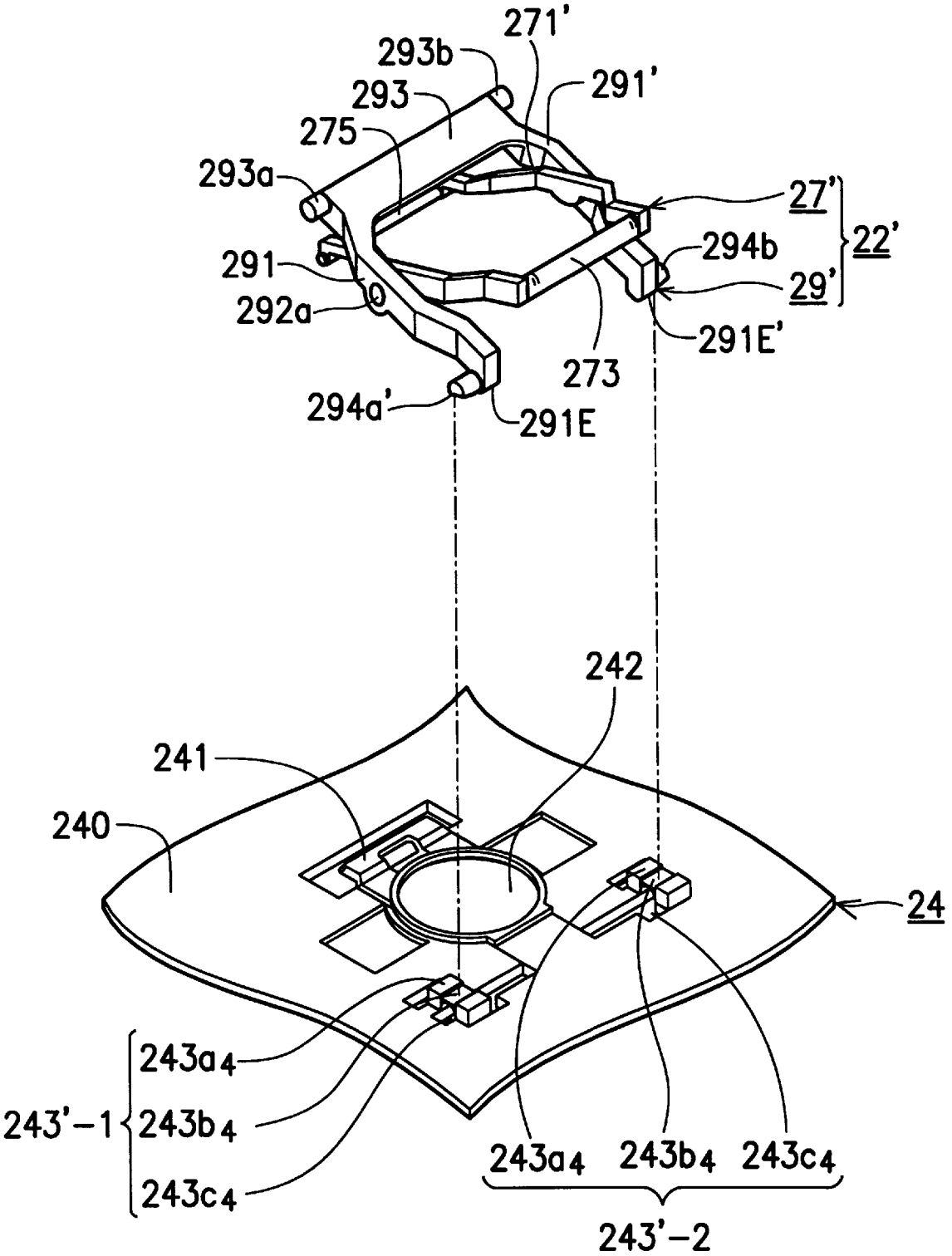
FIG. 7 is an enlarged perspective view depicting the linked first and second linking brackets and the base plate after they are put together according to second embodiment of the present invention.
Figure 8:
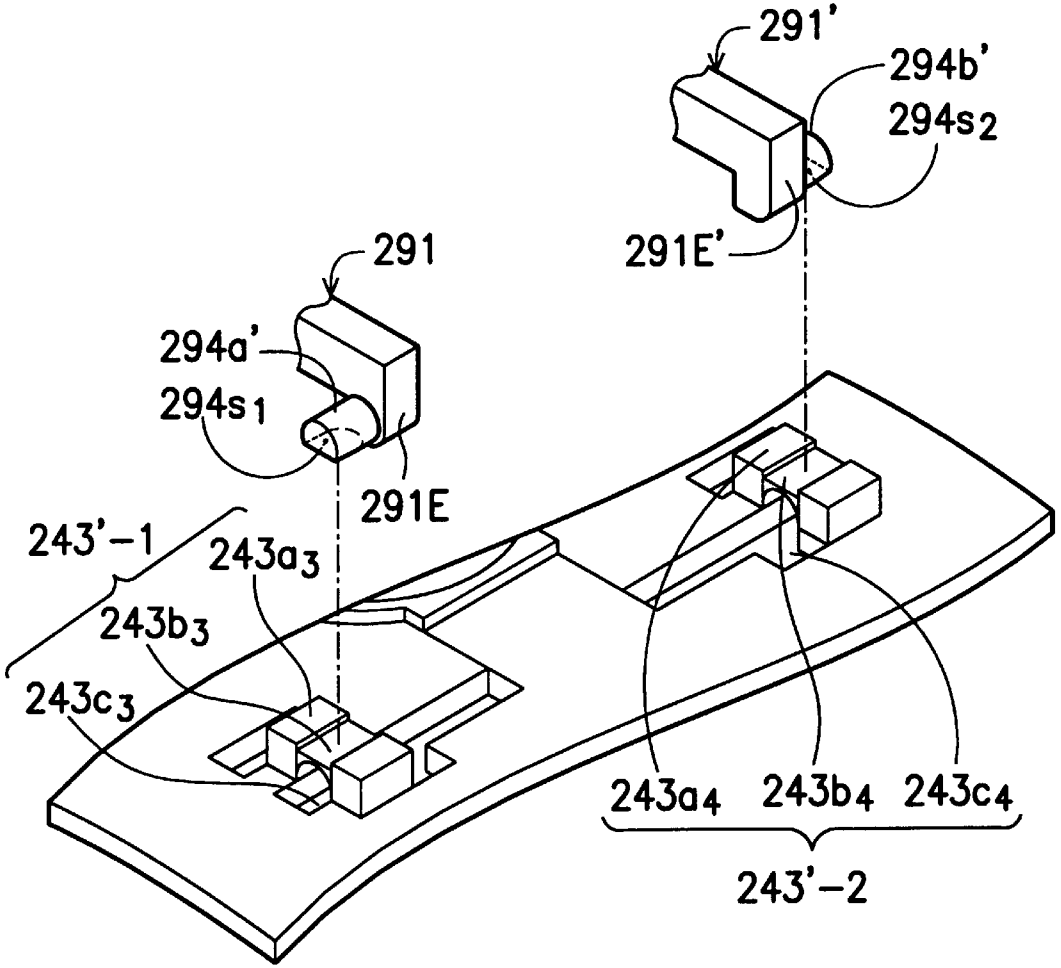
FIG. 8 is an enlarged exploded view of FIG. 7 showing the mounting of two cylindrical protrusions into the bearing slots with a single push according to the second embodiment of the present invention.

Second Embodiment:

The second embodiment is identical to the first embodiment except as follows. Referring to FIG. 7 and 8, bearing slots 243'-1 and 243'-2 are each integrally formed on the surface 240 with a recessed strip 243$b_3$ (243$b_4$) in surface 243$a_3$ (243$a_4$) over rectangular groove 243$c_3$ (243$c_4$), forming a recess thereunder. The recesses can be formed in the shape of a cylindrical hollow. In this embodiment, the recessed area 243$b_3$ (243$b_4$) is not tilted, or slanted, as it is in first embodiment. Instead, the second linking bracket 29', as it is according to the second embodiment of the present invention, is characterized by a slanted surface 294$s_1$ and a slanted surface 294$s_2$ under the second cylindrical protrusions 294*a*' and 294*b*', respectively, such that both slanted surfaces are tilted at an angle away from each other. In another word, the second cylindrical protrusions 294*a*' and 294*b*' are both chamfered at the bottom.

Accordingly, the second linking bracket 29' is assembled to the base plate 24' by first placing the cylindrical protrusions 294*a*' and 294*b*' directly over the corresponding bearing slot 243'-1 and bearing slot 243'-2, and then pushing said protrusions straight down towards the base plate 24' until they snap in and are retained in grooves 243$c_3$ and 243$c_4$ by strips 243$b_3$ and 243$b_4$. Specifically, when the cylindrical protrusions 294*a*' and 294*b*' are pressed against the flat recessed surfaces 243$b_3$ and 243$b_4$ of the bearing slots, an opposing force will be automatically exerted by the slanted surfaces 294$s_1$ and 294$s_2$ so as to redirect a portion of the downward force to squeeze the second arm elements 291 and 291' and decrease in the distance between the two said protrusions for a quick and easy insertion into the bearing slots. In order to further simplifying the assembly process, the longitudinal edges of the grooves 243$c_3$ and 243$c_4$ can be chamfered to provide strips of slanted surfaces on surface 240 immediately adjacent to and along the edges of the grooves for easier slip-in of the second cylindrical protrusions 294*a*' and 294*b*'.

Figure 9:
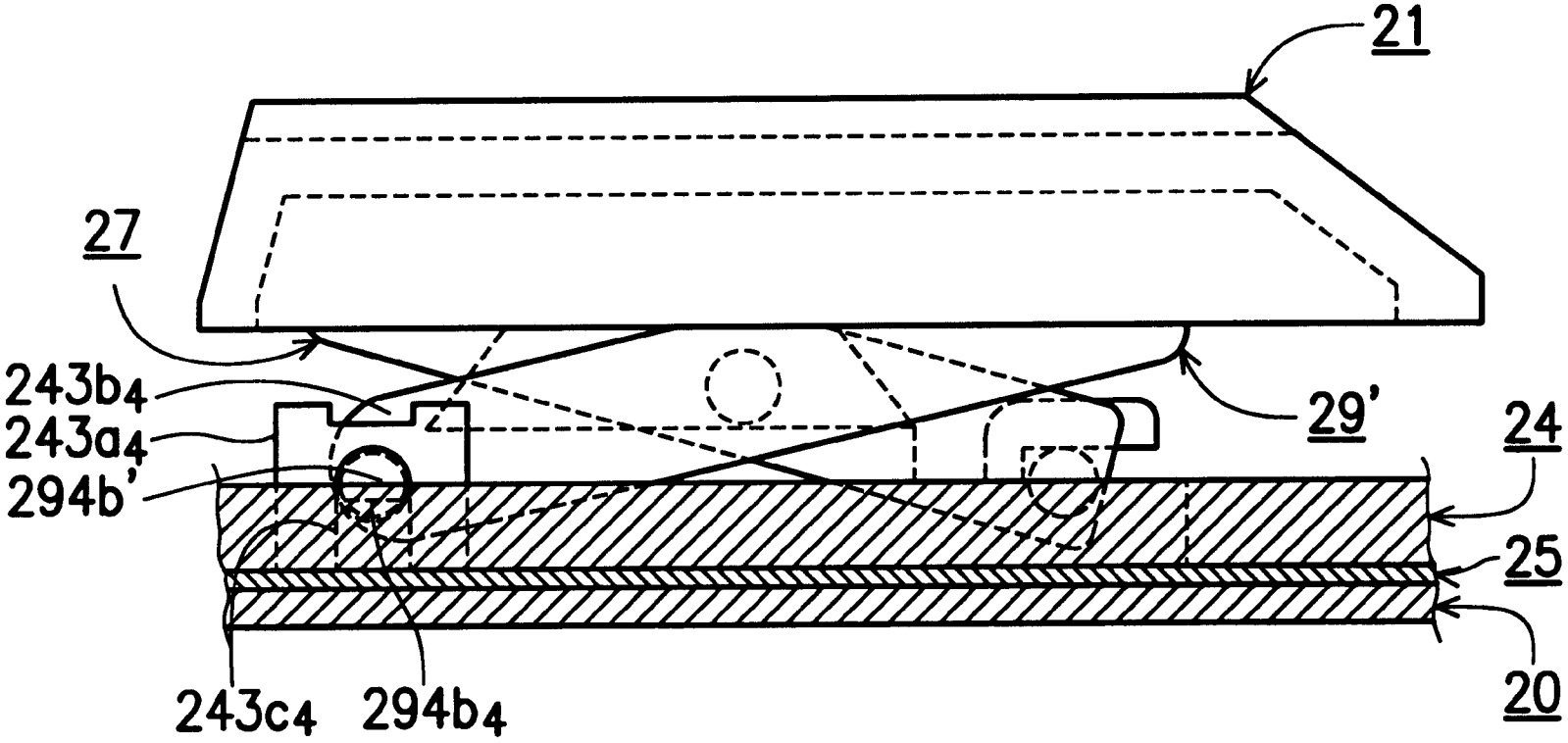
FIG. 9 is a side view of the key cap and the rest of the push button switch assembly thereto in an elevated position according to second embodiment of the present invention.

FIG. 9 is a side view of the fully assembled push button switch according to the second embodiment of the present invention after the second cylindrical protrusions 294*a*' and 294*b*' are inserted to the rectangular grooves 243$c_3$ and 243$c_4$. Note, the slanted surfaces 294$s_1$ and 294$s_2$ (not shown in FIG. 9) of chamfered second cylindrical protrusions 294*a*' and 294*b*' do not obstruct the rotational movement of said second cylindrical protrusions 294*a*' and 294*b*' in any way.

Figure 10:
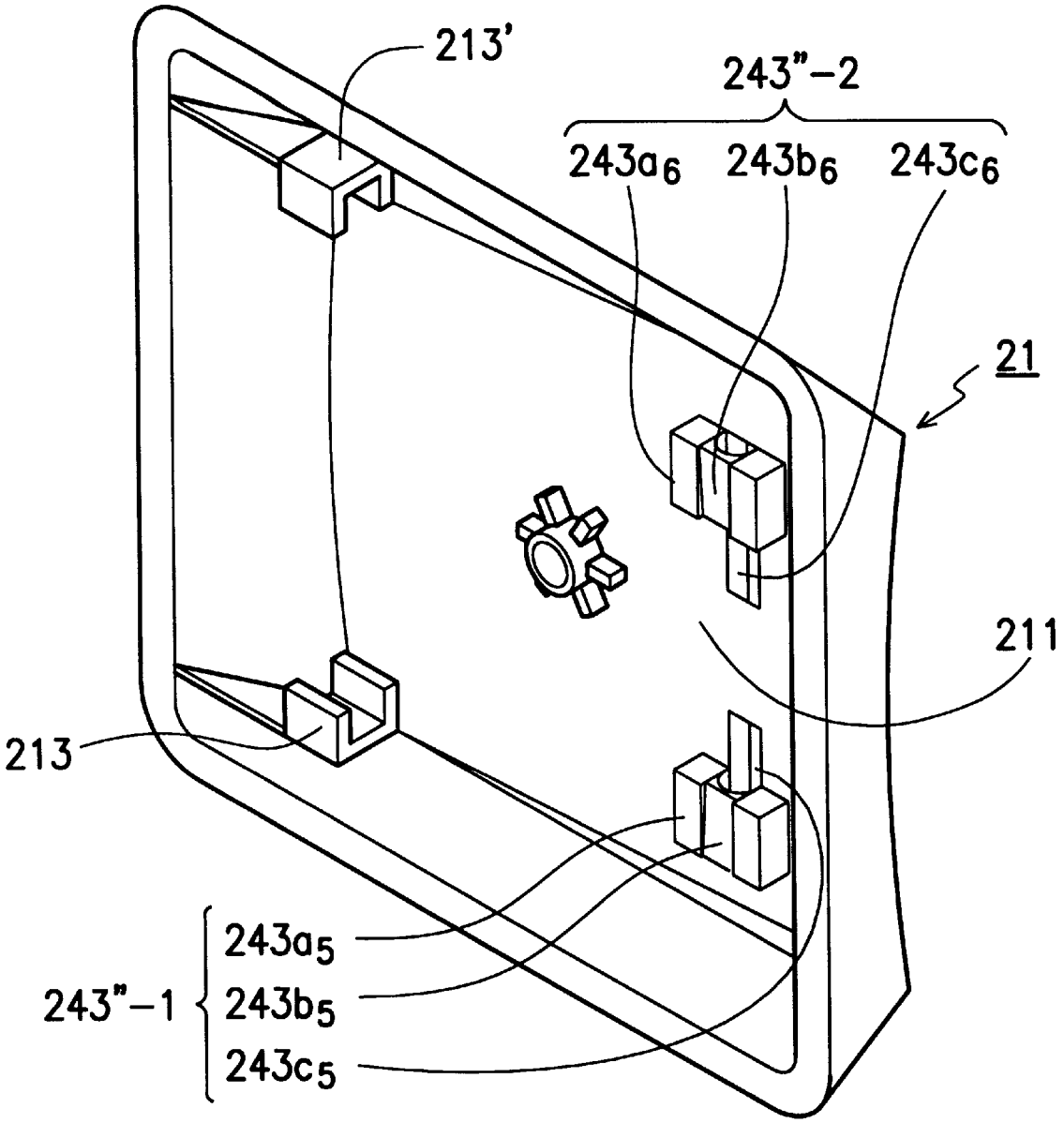
FIG. 10 is an enlarged perspective view of the key cap with its underside revealed according to the third embodiment of the present invention.

Third Embodiment:

As briefly disclosed in the First Embodiment, whereas in place of bearing rod 273 of the rectangular first linking bracket 27, lateral latch members similar to the second cylindrical protrusions 294*a* (294*b*) of the second linking bracket 29 can be provided, and in place of third bearing slots 215 and 215' of the key cap 21, grooves with a slanted strip over a portion of each groove for a quick and easy insertion into the underside 211 of the keycap 21. FIG. 10 reveals the underside 211 of a keycap 21 with a pair of bearing slots 243"-1 and 243"-2 such that the second end of the first linking bracket is assembled to the base plate 24 by first placing the cylindrical protrusions locating at the second end directly over the corresponding third bearing slot 243"-1 and 243"-2, and then pushing said protrusions straight down towards the base plate 24 until they snap in and are retained in grooves 243$c_1$ and 243$c_2$ by surfaces 243$b_1$ and 243$b_2$. Specifically, when the second end of the first linking bracket, in the form of cylindrical protrusions or others, are pressed against the slanted surfaces of the third bearing slots, an opposing force will be automatically exerted by the slanted surfaces that redirect a portion of the downward force to squeeze the first arm elements 271 and 271' and close in on the distance between them, allowing for a quick and easy insertion into said third bearing slots. The keycap with said bearing slots having slanted top surfaces is capable of quickly connecting to the second end of the first linking bracket by a simple push-down action, similar to the connecting action for linking the second cylindrical protrusions 294*a* (294*b*) of the second linking bracket to the base plate.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A push button switch, comprising:

a base plate having at least a first slide guiding slot and two first bearing portions, wherein each of the two first bearing portions comprises a block element formed on the base plate a recess having a slanted bottom surface integrally formed on the block element, and a groove formed vertically below the recess, and wherein each of the slanted surfaces of the recesses slants down slightly towards the other recess;

a key cap having an underside and movable along a specified path between a higher position and a lower position, wherein at least a second slide guiding slot and at least a second bearing portion formed on the underside of the key cap;

a first linking bracket comprising at least a first end and at least a second end, wherein the first end is connected to the first slide guiding slot and the second end being connected to the second bearing portion, and wherein at least a first coupling element is integrally formed at a middle point between the first end and the second end;

a second linking bracket having at least a third end and at least a fourth end, wherein the third end is connected to the second slide guiding slot and the fourth end being two second lateral protrusions connected to the first bearing portions, respectively, and wherein at least a second coupling element is integrally formed at a middle point between the third end and the fourth end of the second linking bracket for coupling with the first coupling element of the first linking bracket so as to form a scissors type cross-link;

a plunger made of springy material situated in between the key cap and the base plate, the key cap being elevated dynamically from the lower position to the higher position by the spring action of the plunger; and wherein, during assembly, each of the second lateral protrusions is inserted into the recess then pressed down vertically to slip into the grooves below so that the second protrusions of the second linking bracket are translated towards each other due to the slanted bottom surfaces of the two recesses to close in on the distance between them and that each of the second lateral protrusion can be aligned with the corresponding groove below before being pressed down vertically into the groove.

2. The push button switch as claimed in claim 1, wherein the first coupling element is a laterally formed first protrusion, and the second coupling element is a hole for receiving the first protrusion.

3. The push button switch as claimed in claim 1, wherein the top surface of each block element of said first bearing portion is integrally formed with a recess having a bottom surface such that a slanted surface forms the bottom surface of each of the recesses that slants down slightly towards the other recess.

4. The push button switch as claimed in claim 1, wherein the base plate comprises a membrane circuit switch which is turned on and off by an electricity-conducting bottom surface of the plunger.

5. The push button switch as claimed in claim 4, further comprising a foundation sheet, wherein the membrane circuit switch is sandwiched in between the base plate and the foundation sheet.

6. The push button switch as claimed in claim 1, wherein a circular hole is formed through the base plate such that the plunger is fixed in place by fitting to the circular hole.

7. The push button switch as claimed in claim 1, wherein the plunger is dome-shaped.

8. The push button switch as claimed in claim 1, wherein the first coupling element is a laterally formed first protrusion, and the second coupling element is a hole for receiving the first protrusion.

9. The push button switch as claimed in claim 1, wherein the top surface of each block element of said second bearing portion is integrally formed with a recess having a bottom surface such that a slanted surface forms the bottom surface of each of the recesses that slants down slightly towards the other recess.

10. A push button switch, comprising:

a base plate having at least a first slide guiding slot and two first bearing portions;

a key cap having an underside and movable along a specified path between a higher position and a lower position, wherein at least a second slide guiding slot and at least a second bearing portion formed on the underside of the key cap;

a first linking bracket comprising at least a first end and at least a second end, wherein the first end is connected to the first slide guiding slot and the second end being connected to the second bearing portion, and wherein at least a first coupling element is integrally formed at a middle point between the first end and the second end;

a second linking bracket having at least a third end and at least a fourth end, wherein the third end is connected to the second slide guiding slot and the fourth end being two portions, respectively, such that both of the second lateral protrusions are formed with slanted surfaces that slant away from each other and are received by the first bearing slots, and wherein at least a second coupling element is integrally formed at a middle point between the third end and the fourth end of the second linking bracket for coupling with the first coupling element of the first linking bracket so as to form a scissors type cross-link; and a plunger made of springy material situated in between the key cap and the base plate, the key cap being elevated dynamically from the lower position to the higher position by the spring action of the plunger.

11. The push button switch as claimed in claim 10, wherein the first coupling element is a laterally formed first protrusion, and the second coupling element is a hole for receiving the first protrusion.

12. The push button switch as claimed in claim 10, wherein the top surface of each block element of said first bearing portion is integrally formed with a recess having a horizontally flat bottom surface.

13. The push button switch as claimed in claim 12, further comprising a foundation sheet, wherein the membrane switch is sandwiched in between the base plate and the foundation sheet.

14. The push button switch as claimed in claim 10, wherein the base plate comprises a membrane circuit switch which is turned on and off by an electricity-conducting bottom surface of the plunger.

15. The push button switch as claimed in claim 10, wherein a circular hole is formed through the base plate such that the plunger is fixed in place by fitting to the circular hole.

16. A push button switch, comprising:

a base plate having at least a first slide guiding slot and at least a first bearing portion;

a key cap having an underside and movable along a specified path between a higher position and a lower position with at least a second slide guiding slot and two second bearing portions formed on the underside of the key cap wherein each of the second bearing portions comprises a block element formed on the base plate, a recess having a slanted bottom surface integrally formed on the block element, and a groove formed vertically below the recess, and wherein each of the slanted surfaces of the recesses slants down slightly towards the other recess;

a first linking bracket comprising at least a first end and at least a second end, wherein the first end is connected to the first slide guiding slot and the second end being two second lateral protrusions connected to the second bearing portions, respectively, and wherein at least a first coupling element is integrally formed at a middle point between the first end and the second end of the first linking bracket;

a second linking bracket having at least a third end and at least a fourth end, wherein the third end is connected to the second slide guiding slot and the fourth end being connected to the first bearing portions, and wherein at least a second coupling element is integrally formed at a middle point between the third end and the fourth end of the second linking bracket for coupling with the first coupling element of the first linking bracket so as to form a scissors type cross-link;

a plunger made of springy material situated in between the key cap and the base plate, the key cap being elevated dynamically from the lower position to the higher position by the spring action of the plunger; and wherein, during assembly, each of the second lateral protrusions is inserted into the recess then pressed down vertically to slip into the grooves below so that the second protrusions of the first linking bracket are translated towards each other due to the slanted bottom surfaces of the two recesses to close in on the distance between them and that each of the second lateral protrusion can be aligned with the corresponding groove below before being pressed down vertically into the groove.

* * * * *